US008013274B2

(12) United States Patent
Suzuki et al.

(10) Patent No.: US 8,013,274 B2
(45) Date of Patent: Sep. 6, 2011

(54) HAIR IRON

(75) Inventors: Shuhei Suzuki, Tokyo (JP); Kaoru Kanaya, Tokyo (JP)

(73) Assignee: Planning 1 Inc, Tokyo (JP)

( * ) Notice: Subject to any disclaimer, the term of this patent is extended or adjusted under 35 U.S.C. 154(b) by 474 days.

(21) Appl. No.: 12/184,510

(22) Filed: Aug. 1, 2008

(65) Prior Publication Data

US 2009/0032048 A1 Feb. 5, 2009

(30) Foreign Application Priority Data

Aug. 2, 2007 (JP) ..... 2007-201511
Feb. 28, 2008 (JP) ..... 2008-048667

(51) Int. Cl.
*A45D 1/04* (2006.01)
*A45D 1/06* (2006.01)
*H05B 3/22* (2006.01)

(52) U.S. Cl. ..... 219/225; 132/224; 132/232

(58) Field of Classification Search ..... None
See application file for complete search history.

(56) References Cited

U.S. PATENT DOCUMENTS 3,224,454 A * 12/1965 Quinio et al. ..... 132/232
3,859,497 A * 1/1975 McNair ..... 219/225
3,918,465 A * 11/1975 Barradas ..... 132/232
4,139,014 A * 2/1979 Rowland ..... 132/118
RE30,866 E * 2/1982 Barradas ..... 132/227
4,426,567 A * 1/1984 Gugliotti ..... 219/225
5,365,037 A * 11/1994 Chan ..... 219/222
6,014,977 A * 1/2000 Friedman ..... 132/232
6,029,677 A * 2/2000 Nanba et al. ..... 132/225
6,119,702 A * 9/2000 Habibi ..... 132/224
6,138,685 A * 10/2000 O'Brien et al. ..... 132/207
6,199,558 B1 * 3/2001 Schmidt et al. ..... 132/211
6,627,852 B1 * 9/2003 Savone ..... 219/225
6,667,462 B2 * 12/2003 Lo ..... 219/225
7,271,368 B2 * 9/2007 Yeung ..... 219/222
7,540,289 B2 * 6/2009 Habibi ..... 132/224
RE41,321 E * 5/2010 Okumoto et al. ..... 132/224
2006/0150996 A1 7/2006 Lun et al.
2006/0201527 A1 * 9/2006 Higgins et al. ..... 132/225
2008/0041406 A1 * 2/2008 Le ..... 132/211
2008/0127989 A1 * 6/2008 Chapman et al. ..... 132/118
2008/0202545 A1 * 8/2008 Purvis et al. ..... 132/120
2008/0216856 A1 * 9/2008 Cafaro ..... 132/211

FOREIGN PATENT DOCUMENTS

WO 2007/094550 8/2007

OTHER PUBLICATIONS

European Search Report issued Aug. 24, 2009 in Application No. 08 016 348.8.
European Office Action issued Sep. 1, 2010 in Application No. 08 016 348.8.

* cited by examiner

*Primary Examiner* — Joseph M Pelham
(74) *Attorney, Agent, or Firm* — Wenderoth, Lind & Ponack, L.L.P.

(57) ABSTRACT

A hair iron 1 includes a pair of grips 9 being rotatably connected to a base end so as to be openable and closable; and a heating part 11 being provided to be opposed to a tip end side of each grip 9 wherein each heating part 11 has a flat opposing surface, a rear surface side of the heating part 11 has a curved curling part 13, and at least one curling part 13 has an auxiliary case 15 with a curved surface having a different curvature from that of the curling part 13 so as to be attachable and detachable thereto and therefrom.

8 Claims, 4 Drawing Sheets

HAIR IRON

BACKGROUND OF THE INVENTION

1. Field of the Invention

The present invention relates to a hair iron that curls hair.

2. Description of the Related Art

Japanese Utility Model Registration No. 3117886 (patent document 1) discloses that a cloth sack, which covers each of heating parts provided to be opposed to each other, is attachably and detachably installed on each heating part, and the cloth sack is attached thereto so as to prevent each heating part from being directly put on hair.

Moreover, it is known that in curling hair, the hair is sandwiched between heating parts and rolled up directly using a curved surface of each curved rear surface part to thereby curing hair.

However, the hair iron disclosed in patent document 1 is structured such that the opposed surface portions of the pair of heating parts are covered to suppress heat. If the hair is curled by the hair iron disclosed in patent document 1, the hair is pressed by both sides of each cover so as to wind the hair around the hair iron, causing a problem that the use of the hair iron is limited to curling with a high degree of curvature.

Furthermore, the use of the conventional hair iron, having a structure in which the rear surface portion is curved, will be limited to curling with a fixed degree of curvature.

On the other hand, it has been demanded that the degree (curvature) of curl of hair is increased or decreased according to various hair styles and tastes in hair when the hair is cured using the hair iron.

SUMMARY OF THE INVENTION

In view of the aforementioned circumstances, it is an object of the present invention is to provide a hair iron capable of changing degree of curvature when hair is curled by one hair iron.

In order to solve the aforementioned problem, an invention according to a first aspect of the present invention includes a pair of grips being rotatably connected to a base end so as to be openable and closable; and a heating part being provided to be opposed to a tip end side of each grip, wherein each heating part has a flat opposing surface, a rear surface side of the heating part has a curved curling part, and at least one curling part has an auxiliary case with a curved surface having a different curvature from that of the curling part so as to be attachable and detachable thereto and therefrom.

The invention according to a second aspect of the present invention is that, in the invention according to the first aspect of the present invention, an engaging part is formed on each of both sides of each curling part along a base end side from a tip end side, an engaged part is formed on each of both sides of an auxiliary case, the auxiliary case is inserted from the tip end side of the curling part to the base end side, and the auxiliary case is pullable from the base end side to the tip end side.

The invention according to a third aspect of the present invention is that, in the invention according to the second aspect of the present invention, wherein the engaging part formed on the curling part is a plurality of projections projecting from the tip end side to the base end side with a distance, and the engaged part formed on the auxiliary case is a projection having a linear shape continuous from the base end side to the tip end side and projecting to an inner side of curvature.

The invention according to a fourth aspect of the present invention is that, in the invention according to the first aspect of the present invention, the tip end side of the grip has a step with an outer periphery projected outside an outer surface of the curling part, and when the auxiliary case is inserted from the tip end side, an insertion side end of the auxiliary case abuts against the step of the grip to position the auxiliary case.

The invention according to a fifth aspect of the present invention is that, in the invention according to the first aspect of the present invention, an outer peripheral surface of the curling part has a plurality of protrusions arranged along a circumferential direction with a distance.

The outer peripheral surface of the curling part has protrusions arranged along the circumferential direction.

The invention according to a sixth aspect of the present invention is that, in the invention according to the first aspect of the present invention, an outer peripheral surface of the auxiliary case has a plurality of protrusions arranged along a circumferential direction with a distance.

In the invention according to the first aspect of the present invention, in the case of curling hair, when the heating parts are pulled down along hair so as to sandwich the hair between the heating parts, the grips are rotated to roll up the hair and to press the hair sandwiched between the heating parts on the curling parts and to thereby form a curling habit due to heat.

In the case of reducing degree of curl(curvature), each auxiliary case is attached to the curling part to thereby reduce curvature of a curl surface. By this means, the hair is pressed on the curl surface of the auxiliary case to form the curling habit due to heat, thereby making it possible to provide small curls each having a small degree of curvature.

According to the present invention, attachment or detachment of the auxiliary cases makes it possible to change the curvature in curling hair by one hair iron.

Since attachment or detachment of the auxiliary cases makes it possible to change the degree of curl, it is possible to easily change the degree of curl and achieve a simple structure.

In the invention according to the second aspect of the present invention, the same effect as that of the invention according to the first aspect of the present invention is obtained. Moreover, the auxiliary case is attached by insertion from the tip end sides of the grips. Therefore, it is possible to easily attach and detach the auxiliary case and achieve good operability.

In the invention according to the third aspect of the present invention, the same effect as that of the invention according to the second aspect of the present invention is obtained. Moreover, when no auxiliary case is attached, hair can be dividedly placed between the projections in the curling part. When the auxiliary case is attached, the entire outer surface of the auxiliary case can be used as the curl surface. Therefore, the engaging part and the engaged part do not obstruct the curling part and the curl surface of the auxiliary case.

In the invention according to the fourth aspect of the present invention, the same effect as that of the invention according to the first aspect of the present invention is obtained. Moreover, it is possible to achieve positioning with a simple structure when the auxiliary case is attached.

In the invention according to the fifth aspect of the present invention, the same effect as that of the invention according to the first aspect of the present invention is obtained. Moreover, each of bundles of hair is rolled up with each of bundles of hair placed between the adjacent protrusions of the curling part, and therefore it is possible to prevent hair from being rolled up in a deviated manner. Accordingly, it is possible to smoothly roll up hair and uniformly curl hair.

In the invention according to the sixth aspect of the present invention, the same effect as that of the invention according to the first aspect of the present invention is obtained. Moreover, each of bundles of hair is rolled up with each of the bundles of hair placed between the adjacent protrusions of the auxiliary case, and therefore it is possible to prevent hair from being rolled up in a deviated manner. Accordingly, it is possible to smoothly roll up hair and uniformly curl hair.

DETAILED DESCRIPTION OF THE PREFERRED EMBODIMENTS

The following will explain a first embodiment of the present invention with reference to FIGS. 1 to 5.

Figure 3:
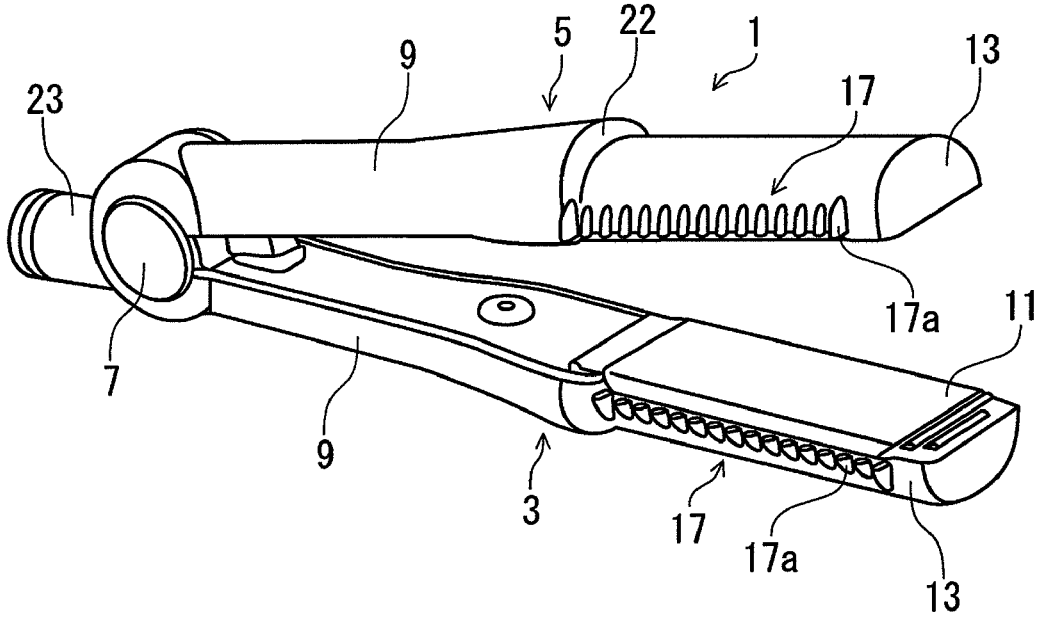
FIG. 3 is a perspective view showing a state that an auxiliary case is detached in the hair iron shown in FIG. 2.

As shown in FIG. 3, a hair iron 1 of the present embodiment includes a pair of arm parts 3 and 5 provided to be opposed to each other. One arm part 3 has the other arm part 5 to be rotatable, and one arm part 3 and the other arm part 5 are urged toward each other in an opening direction by an urging force of a spring (not shown) provided on a rotation shaft 7.

Each of one and other arm parts 3 and 5 has a grip 9 on its base end side (rotation shaft side), and a tip end of the grip 9 has a heating part 11.

Figure 1:
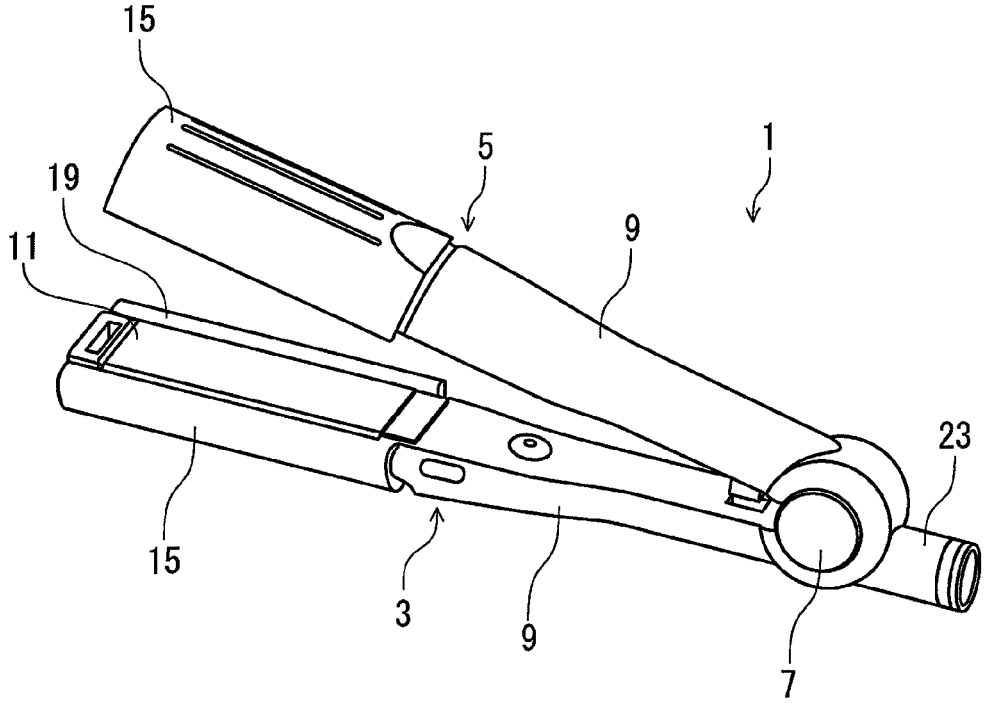
FIG. 1 is a perspective view of a hair iron according to a first embodiment of the present invention.
Figure 2:
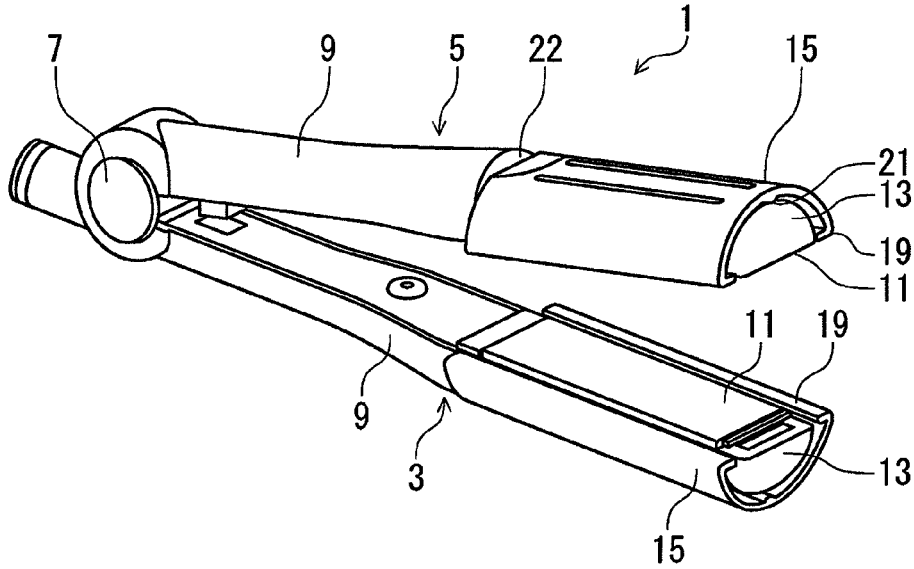
FIG. 2 is a perspective view of the hair iron shown in FIG. 1, seen from another direction.

Each heating part 11 has a flat opposing surface, and a semicircular cylindrical curling part 13 is provided on a rear surface side of the heating part 11. The curling part 13 is made of a heat-resistant resin material. The curling part 13 has an outer periphery whose cross section is a nearly semicircular arch. As shown in FIGS. 1 and 2, a later-described auxiliary case 15 is formed on each curling part 13 so as to be attachable and detachable thereto and therefrom.

As shown in FIG. 3, on both sides of each curling part 13 in its extending direction (a direction along the tip end of the arm part from the base end thereof), there are formed engaging parts 17 along the extending direction. The engaging parts 17 formed on the curling part 13 are projections 17*a* projecting in a row with a distance, and hair can be placed between the projections 17*a* in curling the hair.

Figure 4:
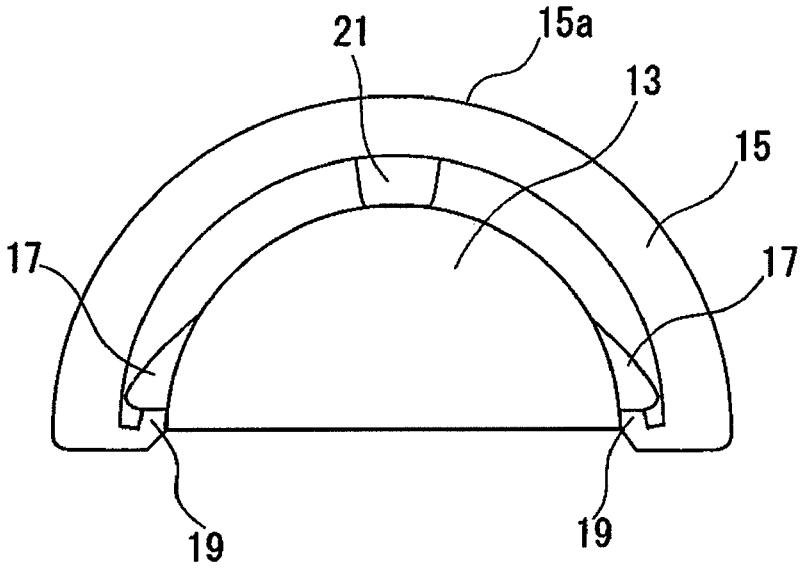
FIG. 4 is a front view of one arm part, seen from a tip end side.

As shown in FIG. 2 and FIG. 4, each auxiliary case 15 has a cross section whose shape is nearly semicircular, and a curved outer peripheral surface 15*a* is used as a curl surface. On each semicircular end portion, the auxiliary case 15 has an engaged part 19 projecting to an inner circumference, and the engaged parts 19 form a continuous linear shape in a longitudinal direction (from the base end side to the tip end side) and are engaged with the engaging parts 17 from the tip end of the curling part 13 to thereby achieve insertion.

Moreover, each auxiliary case 15 has an abutting part 21 abutting against a substantially central portion of the semicircle of the curling part 13 to support a substantially central portion of the semicircle of the auxiliary case 15 when being attached to the curling part 13.

The tip end of each grip 9 has a step 22 whose outer periphery is projected outside the outer surface of the curling part 13. When the auxiliary case 15 is inserted from the tip end side of the curling part 13, an insertion side end of the auxiliary case 15 abuts against the step 22 of the grip 9 to thereby position the auxiliary case 15. It should be noted that one that is provided on a base end sides of the grips 9 is an inserting part 23 of a power cord.

An explanation will be next given of a using method, a function, and an effect in connection with the hair iron 1 according to the present embodiment.

In the case of straightening hair, the hair iron 1 is used in such a manner that hair is sandwiched between the heating parts 11 to extend hair by the hair iron 1 and pull down the hair iron 1 straightly with respect to the hair. In this case, since only the heating parts 11 are used, the auxiliary cases 15 may be detached or attached as they are.

In the case of curling hair, each auxiliary case 15 is attached to the curling part 13 in a state shown in FIG. 3 in reducing degree of curl (curvature). Attachment of each auxiliary case 15 is made in such a manner that the auxiliary case 15 is inserted from its end from the tip end of the curling part 13 to engage the engaged parts 19 of the auxiliary case 15 with the engaging parts 17 formed on both sides of the curling part 13 to make insertion in a pushing manner. The auxiliary case 15 is pushed when the engaged parts 19 are guided and moved along the engaging parts 17 arranged linearly and until the insertion side end of the auxiliary case 15 abuts against the step 22 of the grip 9. When the insertion side end of the auxiliary case 15 abuts against the step 22 of the grip 9, the auxiliary case 15 is positioned.

Namely, attachment of the auxiliary case 15 can be easy achieved by pushing the auxiliary case 15 from the tip end side of the curling part 13 and its positioning can be also achieved.

Figure 5:
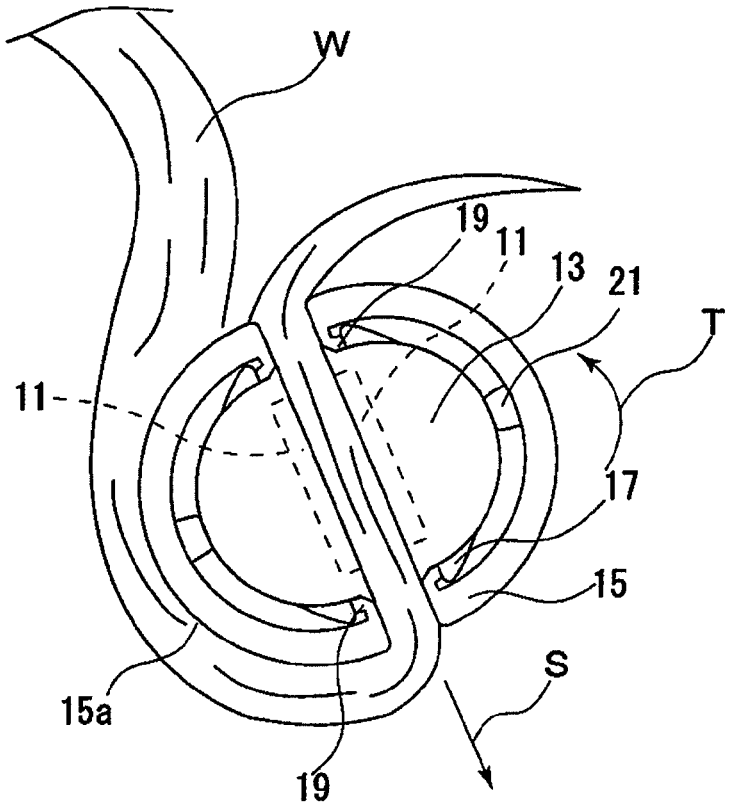
FIG. 5 is a front view explaining a using method of the hair iron according to the first embodiment of the present invention.

In the case of curling hair, as shown in FIG. 5, the grips 9, 9 are rotated in an arrow T direction while the heating parts 11, 11 are pulled down in an arrow S direction along the hair W so as to sandwich the hair W between the heating parts 11, 11, thereby rolling up hair W. Then, the hair W sandwiched between the heating parts 11, 11 is pressed on the outer peripheral surfaces 15*a* of the auxiliary cases 15 to thereby form a curling habit due to heat of the heating part 11.

On the other hand, in the case of increasing degree of hair curl (curvature), the auxiliary cases 15 are detached. The auxiliary cases 15 can be easily detached by pulling them from the tip end sides of the arm parts. After detaching the auxiliary cases 15, that is, in a state shown in FIG. 3, similar to the case shown in FIG. 5, the hair is sandwiched between the heating parts 11, 11 and the hair is pressed on the outer peripheral surfaces of the curling parts 13 to form a curling habit with the curl surfaces each having a high curvature.

In this case, the engaging parts 17 are formed of the plurality of projections 17*a* arranged with a distance along the longitudinal direction of the curling part 13, and therefore the hair can be dividedly placed between the projections 17*a*, 17*a* and the engaging parts 17 do not obstruct curling.

According to the present embodiment, attachment or detachment of the auxiliary cases 15 makes it possible to change the degree of curvature, which is used in curing hair by one hair iron 1, to a higher or lower one.

Attachment or detachment of the auxiliary cases 15 makes it possible to provide the plurality of degrees of curl, and therefore the change in degree of curl can be easily achieved and a simple structure can be also achieved.

The engaged parts 19 of each auxiliary case 15 are projected to the inner circumferential side, and therefore when the auxiliary case 15 is attached, the entire outer peripheral surface can be used as the curl surface and the engaged parts 19 does not become obstacles.

Furthermore, the present embodiment can be used in either case of straightening hair or curling hair.

The following will explain another embodiment of the present invention. In the following explanation, the same reference numerals as those of the first embodiment are added to the parts that have the same function and effect as those of the first embodiment and the explanation of these parts will be omitted, and the following will explain only the difference between the first embodiment and the second embodiment. A second embodiment will be explained with reference to FIGS. 6 to 8.

Figure 6:
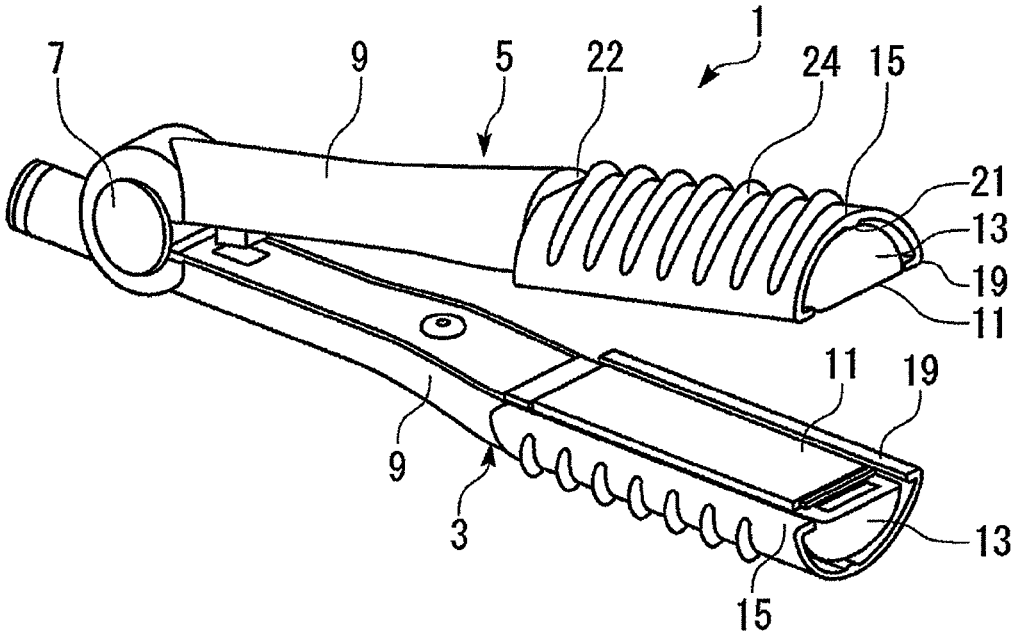
FIG. 6 is a perspective view of a hair iron according to a second embodiment of the present invention.
Figure 7:
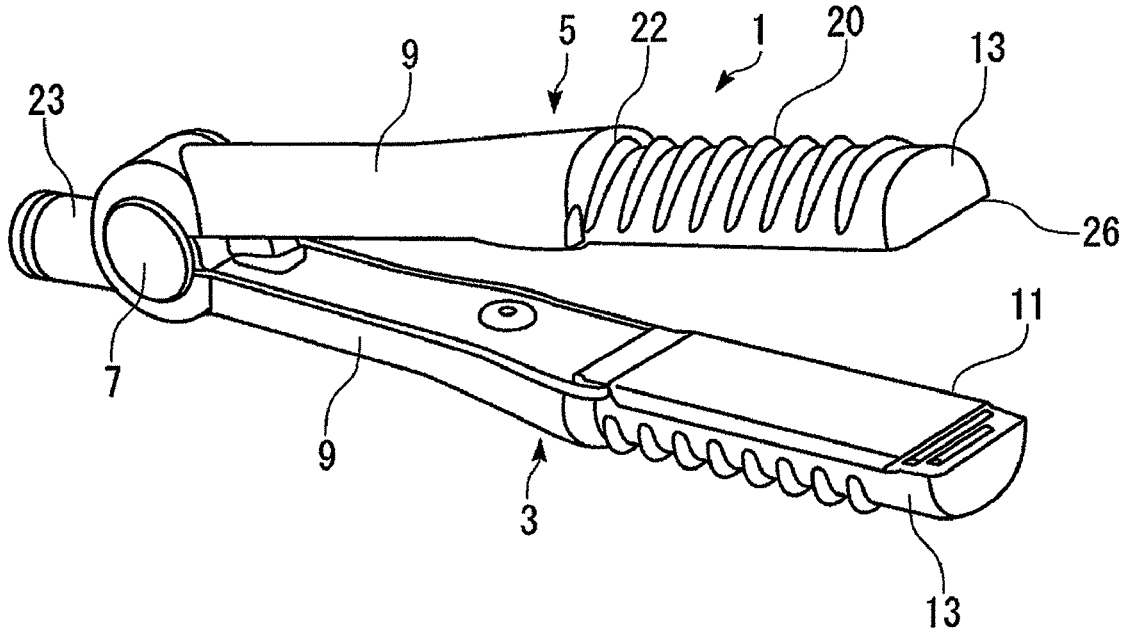
FIG. 7 is a perspective view showing a state that an auxiliary case is detached in the hair iron shown in FIG. 6.
Figure 8:
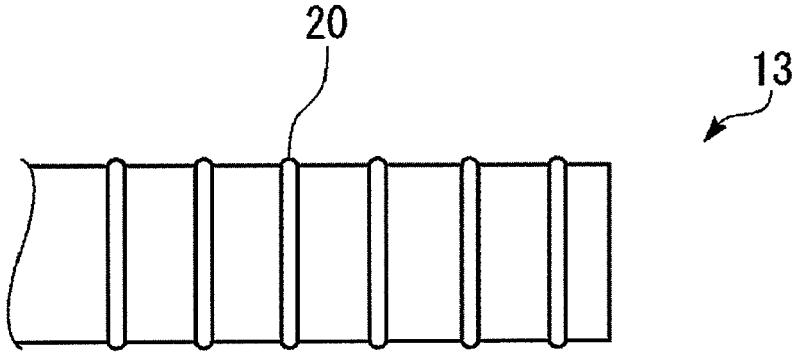
FIG. 8 is a plane view showing a state that a curling part of the hair iron according to the second embodiment of the present invention is detached.

In the present embodiment, as shown in FIGS. 7 and 8, multiple protrusions 20, which are arranged along a circumferential direction, are formed on the outer peripheral surface of the curling part 13 at equal distances to be parallel to one another along the longitudinal direction of the curling part 13. Each protrusion 20 is formed in a direction perpendicular to the longitudinal direction of the curling part 13 as shown in FIG. 8. Furthermore, as shown in FIG. 6, similar protrusions 24 are formed on the outer peripheral surface of the auxiliary case 15.

In the present embodiment, as shown in FIG. 7, no projection (engaging part) 17*a* is formed on the curling part 13, and each of the engaged parts 19 of the auxiliary case 15 and each of edge portions 26 of curling part 13 are engaged with each other, so that the auxiliary case 15 slides with respect to the curling part 13 to be attachable and detachable thereto and therefrom.

According to the present embodiment, each of bundles of hair is rolled up with each of bundles of hair placed between the adjacent protrusions 20 of the curling part 13, and therefore it is possible to prevent hair from being rolled up in a deviated manner. Accordingly, it is possible to smoothly roll up the hair and uniformly curl the hair.

Each of bundles of hair is rolled up with each of the bundles of hair placed between the adjacent protrusions 24 of the auxiliary case 15, and therefore it is possible to prevent the hair from being rolled up in a deviated manner. Accordingly, it is possible to smoothly roll up the hair and uniformly curl the hair.

The present invention is not limited to the aforementioned embodiments, but various variations and modifications may be made without departing from the scope of the present invention.

For example, a plurality of auxiliary cases 15 each having a different curvature of an outer peripheral surface and a different shape may be provided so as to make hair correspond to various degrees of curl and various shapes.

The auxiliary case 15 may be provided on only one of the arm parts 3 and 5 without being limited to each of the one and other arm parts 3 and 5 opposed to each other.

Figure 9:
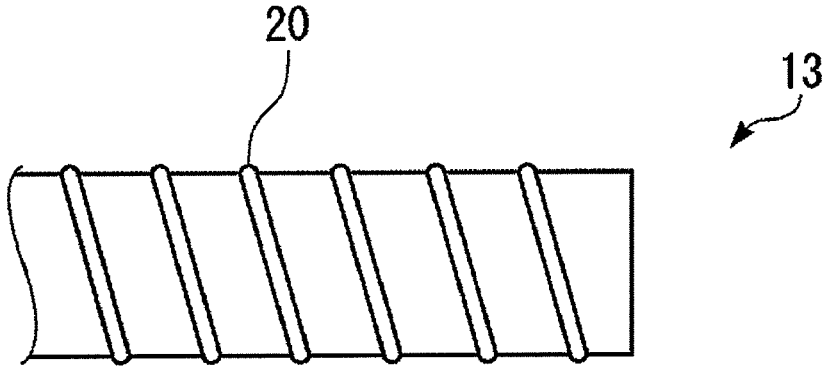
FIG. 9 is a plane view showing a state that a curling part of the hair iron according to a modification of the second embodiment of the present invention is detached.

The protrusions 20 formed along the outer peripheral surface of the curling part 13 may be formed with an angle with respect to the longitudinal direction of the curling part 13 as shown in FIG. 9. Even when hair is rolled up with the grips 9 positioned obliquely, it is possible to smoothly place each of the bundles of hair between the adjacent protrusions 20. Likewise, the protrusions 24 formed on the outer peripheral surface of the auxiliary case 15 may be formed with an angle with respect to the longitudinal direction of the auxiliary case 15.

It is possible to provide a plurality of auxiliary cases 15 each having the different number of protrusions 20 formed on the outer peripheral surface and a different shape so as to adjust an amount of each of bundles of hair to be placed between the adjacent protrusions 24 according to an amount of rolled up hair.

What is claimed is:

1. A hair iron comprising:

a pair of arm parts, each having a base end and a tip end opposite the base end, each arm part having a base-end portion that includes the base end of the respective arm part, and a tip-end portion that includes the tip end of the respective arm part, the arm parts being rotatably connected at the base-end portions of the arm parts so as to be openable and closable with respect to each other;

a pair of heating parts, provided on the tip-end part of the arm parts, respectively, wherein each heating part has a flat surface opposing the flat surface of the other heating part, and each heating part has curling part, which has a curvature; and at least one auxiliary case with a curved surface having a different curvature from the curvatures of the curling parts so as to be attachable to and detachable from either of the curling parts.

2. The hair iron according to claim 1, wherein the curling parts and the at least one auxiliary case each include respective engaging parts with which the at least one auxiliary case is insertable onto and removable from either of the curling parts.

3. The hair iron according to claim 2, wherein the engaging part of at least one of the curling parts comprises a plurality of projections, and the engaging part of the at least one auxiliary case comprises a projection having a continuous linear shape and projecting to an inner side of the curvature of the at least one auxiliary case.

4. The hair iron according to claim 1, further comprising a pair of grips on the base-end portions of the arm parts, respectively, the grips having an end facing the tip end of the arm parts, wherein the ends of the grips have a step with an outer periphery projecting outside an outer surface of the respective curling part, and when the auxiliary case is inserted, the auxiliary case abuts against at least one of the steps so as to position the auxiliary case.

5. The hair iron according to claim 1, wherein an outer peripheral surface of at least one of the curling parts has a plurality of protrusions arranged along a circumferential direction, and the plurality of protrusions are arranged such that neighboring protrusions are separated by a distance.

6. The hair iron according to claim 1, wherein an outer peripheral surface of the at least one auxiliary case has a plurality of protrusions arranged along a circumferential direction, and the plurality of protrusions are arranged such that neighboring rotrusions are separated by a distance.

7. The hair iron according to claim 2, wherein the engaging parts of the curling parts are located such that a plurality of the engaging parts are arranged on each of two opposite sides of each of the curling parts and such that they span in a direction from the tip end toward the base end and such that neighboring engaging parts of the curling parts are separated by a distance, and the engaging parts of the at least one auxiliary case are located on the at least one auxiliary case in such a manner that they span in the direction from the tip end toward the based end when the at least one auxiliary case is inserted onto either of the curling parts.

8. The hair iron according to claim 7, wherein the engaging portions of the at least one auxiliary case are engagable with the engaging portions of either curling part such that the at least one auxiliary case is slideable in a direction from the tip end toward the base end so as to insert the at least one auxiliary case onto said either curling part, and such that the at least one auxiliary case is slideable in a direction from the base end toward the tip end so as to remove the at least one auxiliary case.

* * * * *